US010125329B2

(12) United States Patent
Oprins et al.

(10) Patent No.: US 10,125,329 B2
(45) Date of Patent: Nov. 13, 2018

(54) PROCESS FOR THE PREPARATION OF A FEEDSTOCK FOR A HYDROPROCESSING UNIT

(71) Applicants: Saudi Basic Industries Corporation, Riyadh (SA); SABIC Global Technologies, B.V., PX Bergen Op Zoom (NL)

(72) Inventors: Arno Johannes Maria Oprins, Geleen (NL); Thomas Hubertus Maria Housmans, Geleen (NL); Vijayanand Rajagopalan, Bangalore (IN); Ravichander Narayanaswamy, Bangalore (IN)

(73) Assignees: SAUDI BASIC INDUSTRIES CORPORATION, Riyadh (SA); SABIC GLOBAL TECHNOLOGIES B.V., Bergen Op Zoom (NL)

( * ) Notice: Subject to any disclaimer, the term of this patent is extended or adjusted under 35 U.S.C. 154(b) by 0 days.

(21) Appl. No.: 15/120,667

(22) PCT Filed: Dec. 23, 2014

(86) PCT No.: PCT/EP2014/079224
§ 371 (c)(1),
(2) Date: Aug. 22, 2016

(87) PCT Pub. No.: WO2015/128043
PCT Pub. Date: Sep. 3, 2015

(65) Prior Publication Data

US 2017/0015916 A1 Jan. 19, 2017

(30) Foreign Application Priority Data

Feb. 25, 2014 (EP) ..... 14156621

(51) Int. Cl.
*C10G 67/04* (2006.01)
*C10G 49/00* (2006.01)
(Continued)

(52) U.S. Cl.
CPC ..... *C10G 67/049* (2013.01); *C10G 9/36* (2013.01); *C10G 47/00* (2013.01); *C10G 49/00* (2013.01);
(Continued)

(58) Field of Classification Search
CPC ..... C10G 67/049; C10G 47/00; C10G 49/00; C10G 69/06; C10G 9/36; C10G 2300/301;
(Continued)

(56) References Cited

U.S. PATENT DOCUMENTS 6,153,087 A 11/2000 Bigeard et al.
6,270,654 B1 8/2001 Colyar et al.
(Continued)

FOREIGN PATENT DOCUMENTS

CN 1323339 11/2001
CN 1335882 2/2002
(Continued)

OTHER PUBLICATIONS

International Search Report and Written Opinion of International Application No. PCT/EP2014/079224; 8 pages; dated Mar. 25, 2015.
(Continued)

*Primary Examiner* — Randy Boyer
*Assistant Examiner* — Juan C Valencia
(74) *Attorney, Agent, or Firm* — Norton Rose Fulbright US LLP

(57) ABSTRACT

A process for preparing a feedstock for a hydroprocessing unit, the feedstock based on crude oil containing asphaltenes
(Continued)

and the process including mixing crude oil with a predetermined solvent in a ratio such that no aggregation of asphaltenes in the mixture takes place, and feeding the combined mixture to one or more hydroprocessing units.

18 Claims, 2 Drawing Sheets

(51) Int. Cl.
*C10G 69/06* (2006.01)
*C10G 9/36* (2006.01)
*C10G 47/00* (2006.01)

(52) U.S. Cl.
CPC ..... *C10G 69/06* (2013.01); *C10G 2300/205* (2013.01); *C10G 2300/206* (2013.01); *C10G 2300/301* (2013.01); *C10G 2300/302* (2013.01); *C10G 2300/44* (2013.01)

(58) Field of Classification Search
CPC ..... C10G 2300/205; C10G 2300/302; C10G 2300/44; C10G 2300/206
See application file for complete search history.

(56) References Cited

U.S. PATENT DOCUMENTS 7,214,308 B2 5/2007 Colyar
7,279,090 B2 * 10/2007 Colyar ..... C10G 67/00 208/107
7,704,377 B2 4/2010 Duddy et al.
7,938,952 B2 5/2011 Colyar et al.
8,696,888 B2 * 4/2014 Keusenkothen ..... C10G 9/007 208/106
8,926,824 B2 1/2015 Morel
9,005,430 B2 4/2015 Fournier et al.
9,840,674 B2 12/2017 Weiss et al.
2007/0090018 A1 4/2007 Keusenkothen et al.
2007/0295640 A1 12/2007 Tan et al.
2008/0093262 A1 4/2008 Gragnani et al.
2011/0005970 A1 1/2011 Ou et al.
2014/0299515 A1 10/2014 Weiss et al.
2016/0122666 A1 5/2016 Weiss et al.

FOREIGN PATENT DOCUMENTS

CN 1382766 12/2002
JP 61-062591 3/1986
JP 61-130394 6/1986
JP 2005-307103 11/2005
JP 2011-079995 4/2011
WO WO 2016/146326 9/1916
WO 91/17230 A1 11/1991
WO 2013033293 A2 3/2013

OTHER PUBLICATIONS

Search Report issued in Chinese Application No. 201480076214.5, dated Jul. 14, 2017.
Office Action issued in corresponding Japanese Patent Application No. 2016-570166, dated May 15, 2018.

* cited by examiner

PROCESS FOR THE PREPARATION OF A FEEDSTOCK FOR A HYDROPROCESSING UNIT

This application is a § 371 of International Application No. PCT/EP2014/079224 filed Dec. 23, 2014, and claims priority from European Patent Application No. 14156621.6 filed Feb. 25, 2014.

TECHNICAL FIELD AND BACKGROUND OF THE INVENTION

The present invention relates to a process for the preparation of a feedstock for a hydroprocessing unit, wherein said feedstock is based on crude oil containing asphaltenes.

Refineries are facing the challenges of oil becoming heavier and worse. Asphaltenes are the most difficult components in processing of heavy oils, which is a complex macromolecule that contains the majority of impurities such as S, N, Ni and V. The composition, structure and concentration of asphaltenes highly determine the quality and processing effect of heavy oil to a certain degree. Hydroprocessing is one of the most effective technologies of heavy oil processing. However, during hydroprocessing carbon deposit and pore blocking on the surface of catalysts are easily to occur because of the congregation and coking of the constituents of asphaltenes, which can greatly shorten the operational life span of the catalyst and the running period of the plant. These high molecular weight, large multi-ring aromatic hydrocarbon molecules or associated heteroatom-containing (e.g., S, N, O) multi-ring hydrocarbon molecules in heavy oils are called asphaltenes. A significant portion of the sulphur is contained within the structure of these asphaltenes. Due to the large aromatic structures of the asphaltenes, the sulphur can be refractory in nature and can be difficult to remove.

Asphaltenes are thus present in the crude oil along with other components which aid in keeping them in dissolved state. In the process of crude distillation, most of these other components present in the lower boiling ranges than asphaltenes are removed from the crude oil. This concentrates the asphaltenes in the residue. Depending on the solubility of asphaltenes in the crude oil residue, it can crash out of the solution due to aggregation and precipitate as solids. Precipitated asphaltenes in downstream hydroprocessing units leads to catalyst fouling and lower time-on-stream for the hydroprocessing reactors.

US patent application No 2007/090018 relates to a process comprising: (i) obtaining a hydroprocessed effluent from a resid hydroprocessing unit, wherein the effluent comprises 650 [deg.] F.+(343 [deg.] C.+) resid; (ii) steam cracking substantially all of the effluent to obtain a product comprising olefins. Crude or resid-containing fraction thereof, particularly atmospheric resid, vacuum resid, or any asphaltene-containing refinery or chemical intermediate stream are a feed to the hydroprocessor. The product of each of the steam crackers is sent to the steam cracker product recovery section, where various products may be recovered by separation. Tar from the product recovery unit, heated to a temperature of from about 100 [deg.] C. to about 200 [deg.] C. to maintain fluidity, and containing substantially no metals, and comprising very little asphaltenes and other 1050 [deg.] F.+ materials, is passed to the hydroprocessor, wherein the tar is being diluted with the feed to the hydroprocessor. The objective of this reference is to maximize conversion of asphaltene by steam cracking and recycling it for hydroprocessing and utilizes segregation of asphaltenes.

WO91/17230 relates to a process for the production of normally gaseous mono- and di-olefins, particularly ethylene, propylene and butadiene, by thermally cracking a hydrocarbon feedstock in the presence of steam at elevated temperatures which involves introducing a hydrogen donor material, such as hydrotreated steam cracked tar oils, into a stream of steam cracked effluent at or downstream of the point where the furnace effluent reactions are quenched so as to prevent thermal degradation reactions of the steam cracked liquids.

US Patent application No 2011/005970 relates to a cracking process that treats steam cracker tar fractions by exposure to heat in the presence of hydrogen donor compounds to prevent or decrease formation of at least a portion of high boiling molecules, including asphaltenes and/or asphaltene precursors, within the effluent stream, comprising: a) feeding a hydrocarbon feedstock having a final boiling point above 260° C. to a steam cracking furnace containing a radiant section outlet producing a steam cracker tar-containing effluent, b) adding a hydrogen donor-rich hydrocarbon stream comprising naphthenic compounds to at least a portion of the steam cracker tar-containing effluent while the tar-containing effluent is at a temperature of from 200° to 850° C. to form a mixture comprising hydrogen donor-rich hydrocarbons and steam cracker tar-containing effluent; and c) separating the mixture into i) at least one tar-lean product containing a first tar; and ii) a tar-rich product containing a second tar, the tar-rich product having a final boiling point above the final boiling point of the at least one tar-lean product.

US patent application No 2007/295640 relates to a composition comprising an asphaltenes solvent and a viscosity reducing agent, the asphaltenes solvent and viscosity reducing agent present in a ratio so as to substantially reduce viscosity of an asphaltenes-containing material while substantially negating deposition of asphaltenes either in a reservoir, in production tubing, or both when mixed or otherwise.

WO2013/033293 relates to a process for producing a hydro processed product, comprising: exposing a combined feedstock comprising a heavy oil feed component and a solvent component to a hydroprocessing catalyst to form a hydro processed effluent, separating the hydroprocessing effluent to form at least a liquid effluent and fractionating a first portion of the liquid effluent to form at least a distillate product, wherein the solvent comprises at least a portion of the distillate product, at least 90 wt. % of the at least a portion of the distillate product having a boiling point in a boiling range of 149 DEG C. to 399 DEG C.

Cracked distillate is a by-product obtained in the thermal cracking of a cracker feedstock, which by-product comprises a mixture of hydrocarbons with a boiling range of between 80 and 260 DEG C., at least 35 wt. % of which consists of unsaturated hydrocarbons. 'Cracked distillate' is also understood to be a fraction of unsaturated compounds that can be polymerised into a resin, obtained from distillation of coal tar. The liquid product of the cracking process is known as black oil. Black oil is highly aromatic and constitutes a valuable feedstock for the production of carbon black and for the manufacture of electrodes.

In a situation in which the commercial need for both cracked distillate and carbon black oil is decreasing new technical markets and end uses for these products need to be developed.

Not only carbon deposit and pore blocking on the surface of catalysts are unwanted phenomena but the presence of high amounts of sulphur in the feedstock as well. These sulphur-containing and/or nitrogen-containing organic compounds may compete for the active catalyst sites in the reaction zone in hydroprocessing units as a result of which hydrocracking reaction performance is affected.

BRIEF SUMMARY OF THE INVENTION

An object of the present invention is to provide a process for the preparation of a feedstock for a hydroprocessing unit in which feedstock the aggregation of asphaltenes in crude oil is reduced to a minimum, i.e. as to keep the asphaltenes in a dissolved state.

Another object of the present invention is to provide a feedstock for a hydroprocessing unit resulting in a long operational life span of the catalyst and a long running period of the plant.

Another object of the present invention is to provide a valuable use for steam cracker cracked distillate (CD) and steam cracker carbon black oil (CBO).

The present invention thus relates to a process for the preparation of a feedstock for a hydroprocessing unit, wherein said feedstock is based on crude oil containing asphaltenes, said process comprising the steps of:

mixing said crude oil with a solvent, wherein said solvent is at least one member chosen from the group of steam cracker cracked distillate (CD), steam cracker carbon black oil (CBO), low asphaltenes containing crude oil residue having a boiling point above 300 deg C. and aromatic rich hydrocarbons streams, wherein a mixing ratio solvent:crude oil is such that no aggregation of asphaltenes in said combined mixture of solvent and crude oil takes place under mixing conditions;

feeding said combined mixture of solvent and crude oil to one or more hydroprocessing units.

According to the present method the aggregation of asphaltenes is reduced or even prevented by mixing atmospheric residue (AR) or vacuum residue, with solvent, preferably aromatic rich streams. Thus, the present inventors found a method for keeping asphaltenes in solution by applying appropriate mixing ratio of feed and solvent. The solvent used in the present method is preferably at least one member chosen from the group of steam cracker cracked distillate (CD), steam cracker carbon black oil (CBO), low asphaltenes containing crude oil residue having a boiling point above 300 deg C. and aromatic rich hydrocarbons streams, said streams having low sulphur content. The present inventors assume that by this use of these solvents a proper stabilization of asphaltenes is achieved. In addition, because of higher aromatic content of these streams compared to their paraffinic content, the present inventors assume that the solubility of asphaltenes is enhanced. Furthermore, the present inventors assume that by the use of these solvents in combination with a crude oil a feedstock having lower sulphur content is obtained than a feedstock only composed of crude oil.

The present inventors found that the feed blend to the one or more hydroprocessing unit preferably comprises 25 wt. % or more of cracked distillate, based on the total weight of the feed blend. According to another embodiment the feed blend to the one or more hydroprocessing unit preferably comprises more than 25 wt. % of low asphaltenes containing crude oil, atmospheric or vacuum residue, based on the total weight of the feed blend. According to yet another embodiment the feed blend to the one or more hydroprocessing unit preferably comprises a maximum of 55 wt. % of the higher asphaltenes containing crude stream in combination with lower asphaltenes containing crude oils and aromatic streams like CD, LCO.

Preferred examples of aromatic-rich hydrocarbon streams include steam cracker pygas (aromatics 60 wt %), mixed plastic waste pyrolysis oil (aromatics 75 wt %), FCC cracked gasoline (aromatics 40+%), LCO (aromatics 70-80%), HCO (aromatics 70-80%) or such. These streams can have a boiling point from their initial boiling point to below or above 300 deg C. and be used as solvents in appropriate mixing ratios that preferably satisfy the ASTM required S value, as mentioned below. These initial boiling points could be 35 deg C. or less for naphtha range materials or above 220 deg C. for diesel range materials. Only in the embodiments of crude residues used as solvent their boiling points are specified as above 300 deg C. because usually the residue cuts AR or VR for crude oil anyway is boiling above 300 deg C.

According to the present invention it is preferred that the solvent used is rich in aromatics and resins and lean in asphaltenes as compared to the crude oil such that the combined mixture of the feed, that is the crude oil, and solvent prior to entering the hydroprocessing unit or its feed heaters preferably has a S value, measured as per ASTMD7157-12, of greater than 1.

Even though the above discussed US patent application No 2007/090018 refers to mixing crude oil with solvent, this reference is totally silent about any criteria as provided by the present invention. Moreover, if one were to consider all the figures of this reference, it is obvious that asphaltenes is taken out in the flash chambers shown in the figures, namely this reference relies on asphaltenes precipitation whereas the present invention relies on keeping asphaltenes in solution. The objective is conversion of asphaltenes or asphaltene rich streams by using a hydroprocessing unit with the intention of opening up the rings and this reference thus lacks to the present method of keeping the asphaltenes in solution and preventing segregation.

In addition, it is furthermore preferred that the solvent used in the present method process is majorly liquid at the conditions prevailing in the mixing zone of feed and solvent as well as in the hydroprocessing unit or its feed heaters. It is also preferred that the solvent is capable of being hydro processed in the hydroprocessing unit, preferably at least partly.

In the present process the solvating power of these solvents for asphaltenes is used while co-processing them in hydroprocessing reactors. The term "mixing conditions" include a temperature range at which mixing of solvent and crude oil takes place. And this temperature range is maintained during at least the transport of the mixture thus obtained and the processing of the mixture in hydroprocessing unit(s).

In the present process the crude oil is preferably a bottom stream from a crude oil distillation unit (CDU) and/or vacuum distillation unit (VDU).

The present process further preferably comprises a step of deasphalting the crude before the step of mixing with a solvent as mentioned above. Solvent deasphalting is a physical, separation process, where feed components are recovered in their original states, i.e., they do not undergo chemical reactions. A solvent is used to separate the components of the heavy crude oil fractions.

Examples of solvents used in a deasphalting unit are propane or light paraffinic solvent or various blends of C3-C7 hydrocarbons including light naphthas. It is a flexible process, which essentially separates atmospheric, and vacuum heavy residues, typically into two products: (i) asphalt and (ii) deasphalted or demetallized oil. Although solvent deasphalting methods are carried out without catalysts or adsorbents, it is also possible to apply solvent deasphalting methods which employ solid adsorbents.

According to the present invention the crude oil thus deasphalted is separated into a stream having a low content asphaltenes and a stream having a high content asphaltenes, wherein said stream having a high content asphaltenes is mixed with the type of solvent as mentioned above, i.e., at least one member chosen from the group of steam cracker cracked distillate (CD), steam cracker carbon black oil (CBO) and low asphaltenes containing crude oil residue having a boiling point above 300 deg C. The above discussed US patent application No 2007/090018 teaches a lot of potential feeds to be treated by a process including a first step of hydroprocessing and a second step of thermal cracking, wherein feeds such as whole crude, with or without desalting, namely desalting typically removes metal salts, such as NaCl, or the product of a refinery pipestill or a chemical intermediate stream containing asphaltene, i.e. atmospheric resid or vacuum resid, or steam cracked tar are hydroprocessed using fixed bed hydrogenation reactors or ebullating or fluidized hydrogenation reactors prior to being fed to a thermal pyrolysis unit having a flash pot integrated therewith. However, US patent application No. 2007/090018 fails to disclose a step of deasphalting crude oil.

After the step of mixing the combined mixture of solvent and crude oil is fed to one or more hydroprocessing units, for example chosen from the group of resid hydrocracking unit and coking unit.

The effect of mixing a specific solvent and crude oil is that the sulphur content of the mixed feed is lower than the sulphur content of a feed only comprising crude oil. The present inventors assume that the performance of the hydroprocessing unit is improved as with reduced sulphur content in feed, more active catalyst sites in the hydroprocessing reaction zone are now available for the hydroprocessing reactions.

The resid hydrocracking unit could be selected from fixed, ebullated or slurry bed reactors depending on the asphaltenes content in the mixture as well as a mixture H/C ratio. The process operating conditions for these hydrocracking units include 70-200 barg, 330-500 deg C. with catalysts like Co—Mo or Ni—Mo on alumina or other commercially used hydroprocessing catalysts for that hydrocracking reactor.

The present invention furthermore relates to the use of a solvent chosen from the group of steam cracker cracked distillate (CD), steam cracker carbon black oil (CBO), low asphaltenes containing crude oil residue having a boiling point above 300 deg C. and aromatic rich hydrocarbons streams, or combinations thereof, with crude oil for reducing the metal content of a feed comprising said solvent and said crude oil for a hydroprocessing unit.

In addition, the present invention relates to the use of a solvent chosen from the group of steam cracker cracked distillate (CD), steam cracker carbon black oil (CBO), low asphaltenes containing crude oil residue having a boiling point above 300 deg C. and aromatic rich hydrocarbons streams, or combinations thereof, with crude oil for reducing the viscosity of a feed comprising said solvent and said crude oil for a hydroprocessing unit.

The present inventors further assume a positive effect on the hydrogen consumption in a hydroprocessing unit. The specific solvent, i.e. a solvent chosen from the group of steam cracker cracked distillate (CD), steam cracker carbon black oil (CBO), low asphaltenes containing crude oil residue having a boiling point above 300 deg C. and aromatic rich hydrocarbons streams, may function as a hydrogen donor in a mixture of such a solvent and crude, resulting in less consumption of hydrogen compared to a feed only comprising crude oil in a hydroprocessing unit.

The present inventors thus assume that by mixing these aromatic rich streams with the AR or VR the metal content of the combined feed is reduced as compared to only AR or VR. This makes the demetallizing requirement per unit volume of feed lower in the hydroprocessing reactor. An unexpected effect thereof is that where an ebullated bed reactor (more severe operations) was needed, a fixed bed reactor (less severe operations) can now be used. This would result in savings in capital expenditure for such processing plants.

The present inventors assume the addition of these solvents also reduce viscosity of the AR and VR, making the combined stream easier to pump and more amenable to hydroprocessing.

Also, the present inventors assume that the asphaltenes are more stable in solutions having lower viscosity which is enabled by the present process. As a result fouling of hydroprocessing catalyst by deposition of asphaltenes is reduced and thus a longer on-stream time for the hydroprocessing reactor is now possible.

BRIEF DESCRIPTION OF THE DRAWINGS

The invention will be described in further detail below and in conjunction with the attached drawing.

DETAILED DESCRIPTION OF THE INVENTION

Figure 1:
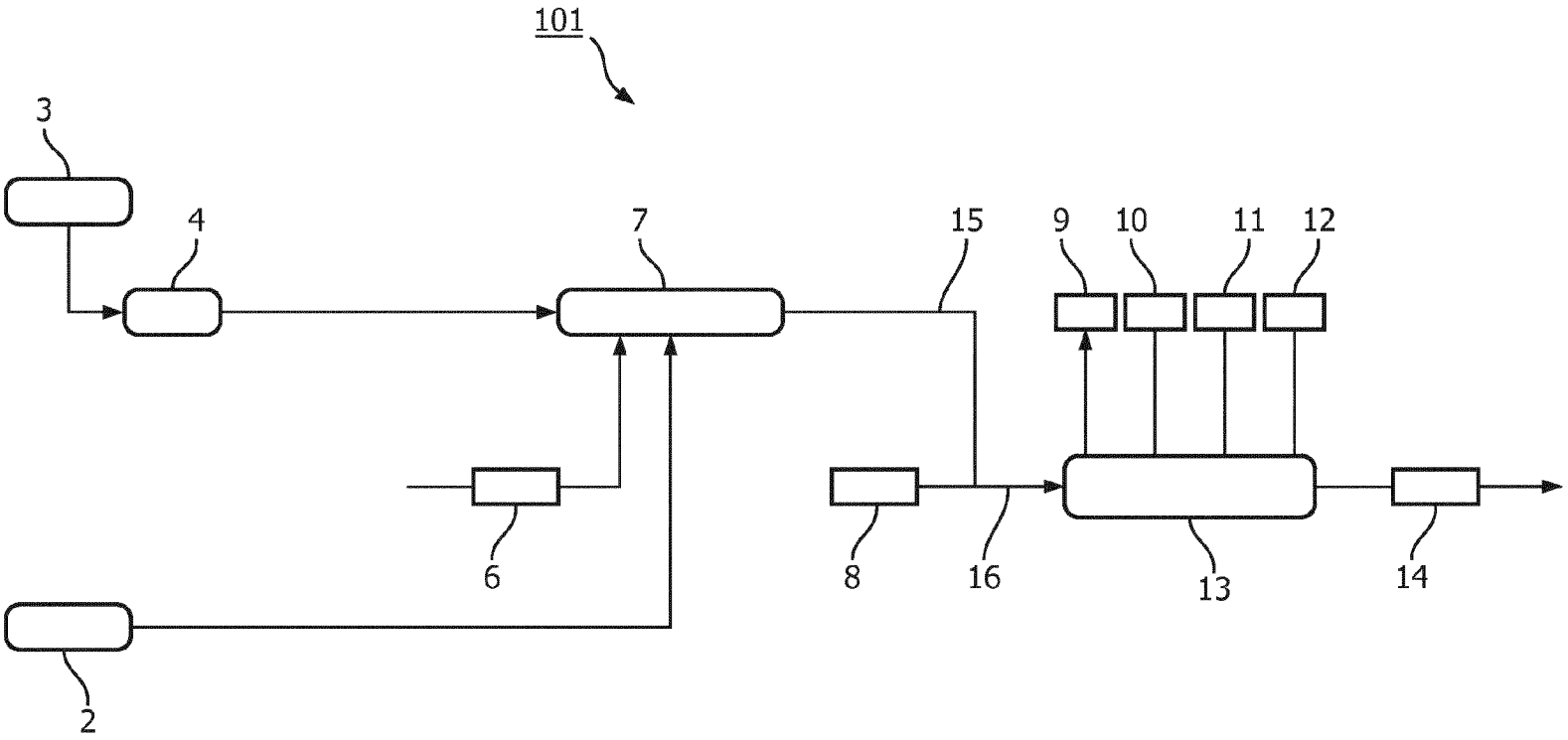
FIG. 1 is a schematic illustration of an embodiment of the process of the invention.

Referring now to the process and apparatus 1 schematically depicted in FIG. 1, there is shown a crude distillation unit 3 from which its bottom stream is sent to a vacuum distillation unit (VDU) 4. The effluent from the vacuum distillation unit 4 is sent tot a solvent dissolution unit 7. In solvent dissolution unit 7 the effluent coming directly from VDU 4 is mixed with a solvent 6. Solvent 6 is chosen from the group of steam cracker cracked distillate (CD), steam cracker carbon black oil (CBO), low asphaltenes containing crude oil residue having a boiling point above 300 deg C. and aromatic rich hydrocarbons streams.

According to another embodiment an additional stream 2, e.g. the effluent from a crude or distillation unit (CDU), is also fed to solvent dissolution unit 7 and mixed with solvent 6 and the effluent coming from VDU 4. By mixing the atmospheric residue or vacuum residue with a specific type of solvent the aggregation of asphaltenes in the mixture thus obtained is significantly reduced. Also the sulphur loading of the mixed stream 15 is lower than the sulphur loading of an untreated effluent coming from VDU 4 and/or CDU 2.

Mixed stream 15, i.e. the effluent from the solvent dissolution unit 7, and hydrogen 8 are further processed in hydroprocessing units 13, for example hydrodesulphurisation, producing individual streams 9, mainly comprising ammonia, stream 10, mainly comprising H2S, stream 11, mainly comprising $C2^{-}$ and stream 13, mainly comprising C3+C4. The effluent from hydroprocessing unit 13 is sent to another hydroprocessing unit 14, for example a resid hydrocracker, a FCC unit or a coker unit.

By mixing solvent 6 with atmospheric residue and/or a vacuum residue the viscosity of feed 15 is significantly reduced. In addition, not only the viscosity of feed 15 is significantly reduced but the metal content of feed 15 is also significantly reduced. Another possible benefit of the mixing step with solvent is that the hydrogen content of feed 16 may be improved.

Figure 2:
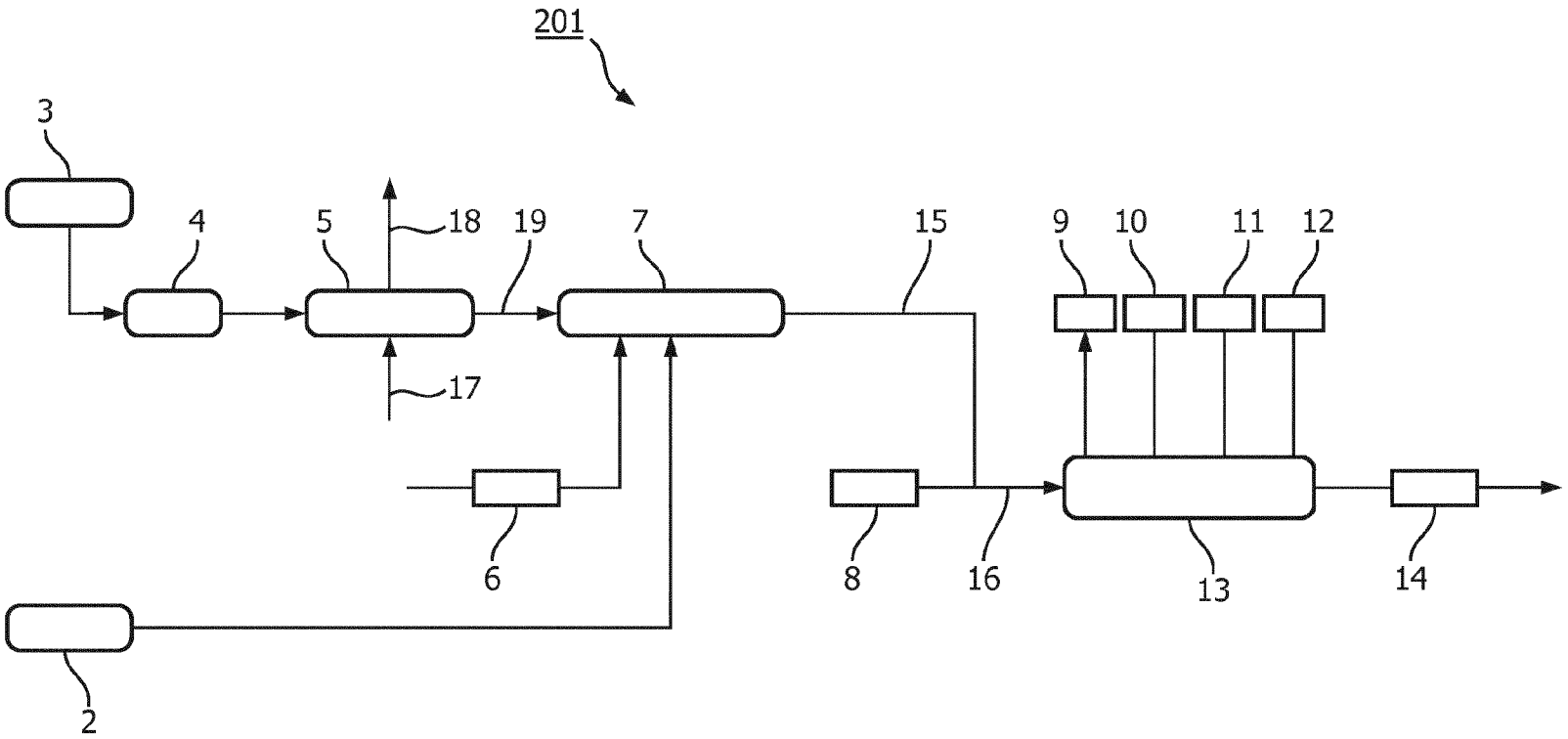
FIG. 2 is a schematic illustration of an embodiment of the process of the invention.

FIG. 2 is a schematic illustration of another embodiment of the process of the invention. The essential difference between the process shown in FIG. 1 and FIG. 2 is the presence of a deasphalting unit 5 located between vacuum distillation unit 4 and solvent dissolution unit 7. In deasphalting unit 5 the effluent from vacuum distillation unit 4 is brought into contact with a solvent stream 17, resulting in a stream 18, i.e. a stream having low content asphaltenes, and a stream 19, i.e. a stream having a high content asphaltenes. Stream 19 is sent to solvent dissolution unit 7 and mixed with solvent 6, i.e. steam cracker cracked distillate (CD) and/or steam cracker carbon black oil (CBO) and/or low asphaltenes containing crude oil residue having a boiling point above 300 deg C. and/or aromatic rich hydrocarbons streams.

The attached Figures and examples represent alternative embodiments of the overall invention. The Figures and examples pertaining to the invention are intended to be viewed as exemplary embodiments within the scope of the overall invention as claimed.

Example 1

The Saturates, aromatics, resins and asphaltenes (SARA) analysis of cracked distillate (CD) from steam cracker is 7.76/92.24/0/0. The 340+ deg C. residue (AHAR) from Arab heavy crude oil has the SARA analysis 53.7/34.8/3.1/8.1. The combination of these streams in different weight proportions is analysed in the below table and the predicted stable asphaltenes concentration for these combinations is presented below.

| | 100% AHAR | 75% AHAR + 25% CD | 50% AHAR + 50% CD | 25% AHAR + 75% CD | 100% CD |
|---|---|---|---|---|---|
| Asphaltenes | 8.1 | 6.08 | 4.05 | 2.03 | 0 |
| Saturates | 53.7 | 42.21 | 30.73 | 19.24 | 7.76 |
| Aromatics | 34.8 | 49.16 | 63.52 | 77.88 | 92.24 |
| Resins | 3.1 | 2.33 | 1.55 | 0.78 | 0.00 |
| Predicted stable Asphaltene concentration in mixture from aromatics and resins concentration in mixture | 4.56 | 6.61 | 8.66 | 10.71 | 12.77 |

As can be seen from the table, stable asphaltenes combinations can be obtained in the mixture of AHAR with CD in all proportions exceeding ~25 wt % CD in the mixture.

Example 2

The Saturates, aromatics, resins and asphaltenes (SARA) analysis of Arab light 340+ deg C. cut (ALAR) is 61.8/30.5/3.4/3.5. The 340+ deg C. residue (AHAR) from Arab heavy crude oil has the SARA analysis 53.7/34.8/3.1/8.1. The combination of these streams in different weight proportions is analysed in the below table and the predicted stable asphaltenes concentration for these combinations based on the concentration of resins and aromatics in the combined mixture is presented.

| | 100% AHAR | 75% AHAR + 25% ALAR | 50% AHAR + 50% ALAR | 25% AHAR + 75% ALAR | 100% ALAR |
|---|---|---|---|---|---|
| Asphaltenes | 8.1 | 6.95 | 5.80 | 4.65 | 3.5 |
| Saturates | 53.7 | 55.73 | 57.75 | 59.78 | 61.8 |
| Aromatics | 34.8 | 33.73 | 32.65 | 31.58 | 30.5 |
| Resins | 3.1 | 3.18 | 3.25 | 3.33 | 3.4 |
| Predicted stable Asphaltene concentration in mixture from aromatics and resins concentration in mixture | 4.56 | 4.40 | 4.25 | 4.10 | 3.95 |

As can be seen from the table, stable asphaltenes combinations can be obtained in the mixture of AHAR and ALAR when ALAR concentration in the mixture is above 75 wt %.

Example 3

Aijun Guo et al, Fuel processing technology 89 (2008) 643-650 provide the Saturates, aromatics, resins and asphaltenes (SARA) analysis of Jinzhou vacuum residue (JnVR) as 17.2/29.6/51.3/1.9. The 340+ deg C. residue (AHAR) from Arab heavy crude oil has the SARA analysis 53.7/34.8/3.1/8.1. The combination of these streams in different weight proportions is analysed in the below table.

| | 100% AHAR | 75% AHAR + 25% JnVR | 50% AHAR + 50% JnVR | 25% AHAR + 75% JnVR | 100% JnVR |
|---|---|---|---|---|---|
| Asphaltenes | 8.1 | 6.55 | 5.00 | 3.45 | 1.9 |
| Saturates | 53.7 | 44.58 | 35.45 | 26.33 | 17.20 |

-continued

| | 100% AHAR | 75% AHAR + 25% JnVR | 50% AHAR + 50% JnVR | 25% AHAR + 75% JnVR | 100% JnVR |
|---|---|---|---|---|---|
| Aromatics | 34.8 | 33.50 | 32.20 | 30.90 | 29.60 |
| Resins | 3.1 | 15.15 | 27.20 | 39.25 | 51.30 |
| Predicted stable Asphaltene | 4.56 | 6.18 | 7.80 | 9.43 | 11.05 |

-continued

| | 100% AHAR | 75% AHAR + 25% JnVR | 50% AHAR + 50% JnVR | 25% AHAR + 75% JnVR | 100% JnVR |
|---|---|---|---|---|---|
| concentration in mixture from aromatics and resins concentration in mixture | | | | | |

As can be seen from the above table, asphaltenes are stable in the mixture containing more than 25 wt % JnVR. This example has been provided as it has a different distribution of resins as compared to example 1. Operating refineries that process a crude basket having asphaltenes-rich and asphaltenes-lean crudes and have different crude units for these different crude types can benefit from a combination of residues from asphaltenes-rich and asphaltenes-lean crude oils and process them together in a hydrocracking unit.

Example 4

The Saturates, aromatics, resins and asphaltenes (SARA) analysis of Arab light 340+ deg C. cut (ALAR) is 61.8/30.5/3.4/3.5. The 340+ deg C. residue (AHAR) from Arab heavy crude oil has the SARA analysis 53.7/34.8/3.1/8.1. The Saturates, aromatics, resins and asphaltenes (SARA) analysis of cracked distillate (CD) from steam cracker is 7.76/92.24/0/0. The combination of these streams in different weight proportions is analysed in the below table.

| | 100% AHAR | 75% AHAR + 15% ALAR + 10% CD | 55% AHAR + 25% ALAR + 20% CD | 40% AHAR + 40% ALAR + 20% CD | 100% ALAR | 100% CD |
|---|---|---|---|---|---|---|
| Asphaltenes | 8.1 | 6.60 | 5.33 | 2.64 | 3.5 | 0 |
| Saturates | 53.7 | 50.32 | 46.54 | 23.23 | 61.8 | 7.76 |
| Aromatics | 34.8 | 39.90 | 45.21 | 52.86 | 30.5 | 92.24 |
| Resins | 3.1 | 2.84 | 2.56 | 1.13 | 3.4 | 0.00 |
| Predicted stable Asphaltene concentration in mixture from aromatics and resins concentration in mixture | 4.56 | 5.29 | 6.05 | 6.99 | 3.95 | 12.77 |

As can be seen from the above table with certain combinations of AHAR, ALAR and CD it is possible to keep asphaltenes from precipitating out.

The invention claimed is:

1. A process for the preparation of a feedstock for a hydroprocessing unit, wherein said feedstock is based on crude oil containing asphaltenes, said process comprising the steps of:

mixing said crude oil with a solvent, wherein said solvent includes at least one of steam cracker cracked distillate (CD), steam cracker carbon black oil (CBO), low asphaltenes containing crude oil residue having a boiling point above 300° C. deg C. and aromatic rich hydrocarbons streams, wherein a mixing ratio of said solvent to said crude oil is such that no aggregation of asphaltenes in said combined mixture of solvent and crude oil takes place under mixing conditions; and feeding said combined mixture of solvent and crude oil to one or more hydroprocessing units, wherein said combined mixture of solvent and crude oil comprises 25 wt. % or more of cracked distillate, based on the total weight of the feed blend.

2. A process for the preparation of a feedstock for a hydroprocessing unit, wherein said feedstock is based on crude oil containing asphaltenes, said process comprising the steps of:

mixing said crude oil with a solvent, wherein said solvent includes at least one of steam cracker cracked distillate (CD), steam cracker carbon black oil (CBO), low asphaltenes containing crude oil residue having a boiling point above 300° C. deg C. and aromatic rich hydrocarbons streams, wherein a mixing ratio of said solvent to said crude oil is such that no aggregation of asphaltenes in said combined mixture of solvent and crude oil takes place under mixing conditions; and feeding said combined mixture of solvent and crude oil to one or more hydroprocessing units, wherein said combined mixture of solvent and crude oil comprises a maximum of 55 wt. % of the higher asphaltenes containing crude stream in combination with the lower asphaltenes containing crude oils and aromatic streams.

3. The process according to claim 1, wherein said combined mixture of solvent and crude oil prior to entering the one or more hydroprocessing units, or its feed heaters, has an S value, measured as per ASTMD7157-12, of greater than 1.

4. The process according to claim 1, wherein said crude oil is a bottom stream from a vacuum distillation unit.

5. The process according to claim 1, further comprising deasphalting said crude oil, and separating the crude oil thus deasphalted in a stream having a low content of asphaltenes and a stream having a high content of asphaltenes, wherein said stream having a high content of asphaltenes is mixed with said solvent.

6. The process according to claim 1, wherein said one or more hydroprocessing units are chosen from the group of a resid hydrocracking unit and a coking unit.

7. The process according to claim 2, wherein said combined mixture of solvent and crude oil prior to entering the one or more hydroprocessing units, or its feed heaters, has an S value, measured as per ASTMD7157-12, of greater than 1.

8. The process according to claim 2, wherein said crude oil is a bottom stream from a vacuum distillation unit.

9. The process according to claim 2, further comprising deasphalting said crude oil, and separating the crude oil thus deasphalted in a stream having a low content of asphaltenes and a stream having a high content of asphaltenes, wherein said stream having a high content of asphaltenes is mixed with said solvent.

10. The process according to claim 2, wherein said one or more hydroprocessing units are chosen from the group of a resid hydrocracking unit and a coking unit.

11. The process according to claim 1, wherein said combined mixture of solvent and crude oil comprises more than 25 wt. % of low asphaltenes containing crude oil, atmospheric or vacuum residue, based on the total weight of the feed blend.

12. The process according to claim 2, wherein said combined mixture of solvent and crude oil comprises more than 25 wt. % of low asphaltenes containing crude oil, atmospheric or vacuum residue, based on the total weight of the feed blend.

13. The process according to claim 4, wherein said combined mixture of solvent and crude oil prior to entering the one or more hydroprocessing units, or its feed heaters, has an S value, measured as per ASTMD7157-12, of greater than 1.

14. The process according to claim 5, wherein said crude oil is a bottom stream from a crude oil distillation unit (CDU).

15. The process according to claim 8, further comprising deasphalting said crude oil, and separating the crude oil thus deasphalted in a stream having a low content of asphaltenes and a stream having a high content of asphaltenes, wherein said stream having a high content of asphaltenes is mixed with said solvent.

16. The process according to claim 3, wherein said one or more hydroprocessing units are chosen from the group of a resid hydrocracking unit and a coking unit.

17. The process according to claim 9, wherein said crude oil is a bottom stream from a vacuum distillation unit (VDU).

18. The process according to claim 17, wherein said combined mixture of solvent and crude oil comprises more than 25 wt. % of low asphaltenes containing crude oil, atmospheric or vacuum residue, based on the total weight of the feed blend.

* * * * *